US008708815B2

(12) United States Patent
Olive

(10) Patent No.: US 8,708,815 B2
(45) Date of Patent: Apr. 29, 2014

(54) GAME METHOD AND GAMING SYSTEM

(75) Inventor: Scott Christopher Olive, Narrabeen (AU)

(73) Assignee: Aristocrat Technologies Australia Pty Ltd (AU)

( * ) Notice: Subject to any disclaimer, the term of this patent is extended or adjusted under 35 U.S.C. 154(b) by 924 days.

(21) Appl. No.: 11/838,643

(22) Filed: Aug. 14, 2007

(65) Prior Publication Data

US 2008/0064496 A1 Mar. 13, 2008

(30) Foreign Application Priority Data

Aug. 18, 2006 (AU) ..... 2006904507

(51) Int. Cl.
*A63F 9/00* (2006.01)

(52) U.S. Cl.
USPC ..... 463/31

(58) Field of Classification Search
USPC ..... 463/31
See application file for complete search history.

(56) References Cited

U.S. PATENT DOCUMENTS 6,375,187 B1 * 4/2002 Baerlocher ..... 273/143 R
6,439,995 B1 * 8/2002 Hughs-Baird et al. ..... 463/20
6,942,566 B2 * 9/2005 Baerlocher et al. ..... 463/16
7,264,545 B2 * 9/2007 Maya et al. ..... 463/16
2002/0142822 A1 * 10/2002 Baerlocher et al. ..... 463/16
2003/0027635 A1 * 2/2003 Walker et al. ..... 463/40
2003/0064795 A1 * 4/2003 Baerlocher et al. ..... 463/25
2003/0114217 A1 * 6/2003 Walker et al. ..... 463/20
2003/0162578 A1 * 8/2003 Baerlocher et al. ..... 463/16
2003/0162584 A1 * 8/2003 Hughs-Baird et al. ..... 463/20
2003/0199313 A1 10/2003 Gonen et al.
2005/0153767 A1 7/2005 Gauselman
2007/0087835 A1 * 4/2007 Van Luchene ..... 463/43

* cited by examiner

*Primary Examiner* — Seng H Lim
(74) *Attorney, Agent, or Firm* — McAndrews, Held & Malloy, Ltd.

(57) ABSTRACT

Certain embodiments provide systems and methods for gaming. A method includes the steps of displaying a set of objects and a set of prizes to a player, the number of objects and prizes being the same; receiving at least one object selection instruction from a player, each object selection resulting in one of the set of prizes becoming unavailable to the player; displaying to the player an award for ending the game that the player can accept or reject; if an award acceptance instruction is received from the player, granting the player the displayed award, or, if an award rejection instruction is received from the player, receiving at least one further object selection instruction, each further object selection instruction resulting in a further prize becoming unavailable to the player; and repeating the previous two steps until either an acceptance instruction is received or a last of the objects remains.

20 Claims, 8 Drawing Sheets

GAME METHOD AND GAMING SYSTEM

RELATED APPLICATIONS

The present application relates to, and claims priority from, Australian Patent Application No. 2006904507, filed on Aug. 18, 2006, entitled "A Game Method and Gaming System," which is herein incorporated by reference in its entirety.

FIELD OF THE INVENTION

The present invention relates to a method of gaming, a gaming system, a game controller and a player interface for a gaming system.

BACKGROUND OF THE INVENTION

Many gaming machines carry out a single game such as a slot machine game involving a display of rotating wheels having symbols, where the resulting symbol combinations correspond to prizes to be paid to the player. Many newer gaming machines provide a "bonus" or "feature" game that occurs in response to a particular event in the "base" or "main" game. Such bonus games are intended to add player excitement and enjoyment. There is a need for other games that are suitable to be used as a bonus or main game.

SUMMARY OF THE INVENTION

In a first aspect, the invention relates broadly to a method of gaming comprising:

(a) displaying a set of objects and a set of prizes to a player, the number of objects and prizes being the same;

(b) receiving at least one object selection instruction from a player, each object selection resulting in one of the set of prizes becoming unavailable to the player;

(c) displaying to the player an award for ending the game that the player can accept or reject;

(d) (i) if an award acceptance instruction is received from the player, granting the player the displayed award or (ii) if an award rejection instruction is received from the player, receiving at least one further object selection instruction, each further object selection instruction resulting in a further one of said prizes becoming unavailable to the player; and (e) repeating steps (c) and (d) until either (i) an acceptance instruction is received or (ii) a last of the objects remains.

In one embodiment, each one of the objects is associated with an individual prize of the set of prizes, the objects being displayed, at least initially, such that associations between objects and prizes are unknown to the player.

In this embodiment, if a last object remains the player is awarded the prize associated with the last object.

Various actions, such as exiting the game, may be deemed an acceptance instruction.

In another embodiment, the award displayed to the player is determined by a game controller based on the prizes associated with the objects that have not been selected at the time the award is displayed.

In an embodiment, the association between an object and a prize is displayed only after the object has been selected.

In an embodiment the displayed award may be offered by another player.

In an embodiment, the game method involves varying the number of objects while keeping the number of prizes equal to the number of objects. In another embodiment, the game method involves varying one or more objects, for example by swapping an object for an object kept in a reserved space. Such variations may be made randomly or in response to bets.

In an embodiment, the number of object selections available to a player may be varied, such as randomly or in response to one or more bets.

The game method may comprise executing a base game and commencing step (a) in response to occurrence of a trigger event in the base game.

In the first aspect, the invention also relates broadly to a game system comprising:

a player interface comprising:

a display for displaying a set of objects and a set of prizes to a player, the number of objects being the same as the number of prizes;

an instruction input mechanism that enables a player to input at least one object selection instruction to select an object and, optionally, an award acceptance instruction or an award rejection instruction; and a game controller in data communication with the player interface and configured to:

(a) make one of the set of prizes unavailable to the player in response to each object selection instruction;

(b) cause the display to display to the player an award for ending the game that the player can accept or reject; and (c) (i) if an acceptance instruction is received from the player accepting the displayed award, grant the player the displayed award or (ii) if a rejection instruction is received from the player rejecting the displayed award, receive at least one further object selection instruction from a player selecting a further one of said set of objects, the game controller further configured to repeat processes (a), (b) and (c) until (i) an acceptance instruction is received or (ii) a last object remains.

In one embodiment, the game controller is in data communication with another player interface operable by another player and configured to receive a game instruction from another player and cause the display to display to the player an award corresponding to the game instruction from said another player.

In the first aspect, the invention also relates broadly to a game controller for a game system comprising:

a memory storing a set of objects and a set of prizes for a game to be played by a player, the number of objects being the same as the number of prizes, the game controller configured to:

(a) receive at least one object selection instruction specifying at least one selected object;

(b) make one of the set of prizes unavailable to the player in response to each object selection instruction;

(c) cause a display to display to the player an award for ending the game that the player can accept or reject; and (d) (i) if an acceptance instruction is received specifying that the player accepts the displayed award, grant the player the displayed award, or (ii) if a rejection instruction is received specifying that the player rejects the displayed award, receive further object selection instructions specifying a further object of the set of objects, the game controller further configured to repeat processes (b), (c) and (d) until (i) an acceptance instruction is received or (ii) a last of the objects remains.

In the first aspect, the invention also relates broadly to a player interface for a game system, the player interface comprising:

a display for displaying a set of objects and a set of prizes to a player, the number of objects being the same as the number of prizes;

an instruction input mechanism that enables a player to input at least one object selection instruction to select one or more objects, (a) the display being updated:

(i) to indicate that a prize has been made unavailable to the player in response to each object selection instruction;

(ii) to display to the player an award for ending the game that the player can accept or reject, (b) the instruction input mechanism enabling a player to enter (i) an acceptance instruction accepting the displayed award, or (ii) a rejection instruction rejecting the displayed award, and if a rejection instruction is entered, the instruction input mechanism enabling the player to enter at least one further object selection instruction, the player interface configured to repeat processes (a) and (b) until (i) an acceptance instruction is entered or (ii) a last of the objects remains.

In a second aspect, the invention broadly relates to a method of gaming comprising:

(a) displaying a set of objects to a first player;

(b) receiving at least one object selection from the first player;

(c) receiving an award instruction from a second player specifying an award that the first player can accept or reject;

(d) displaying the award to the first player so that the first player can accept or reject the award.

In an embodiment, the method comprises:

(e) (i) if an acceptance instruction is received from the first player, granting the first player the displayed award or (ii) if a rejection instruction is received from the first player rejecting the displayed award, receiving at least one further object selection instruction from the first player and a further award instruction from the second player specifying an award; and (f) repeating steps (d) and (e) until (i) an acceptance instruction is received from the first player accepting the displayed award or (ii) another award condition is met.

An award condition may be that a last object remains that corresponds to a last prize.

An award condition may be that a combination of objects has been selected.

In an embodiment, if another award condition has not been met when the first player accepts a displayed award, game play may continue with the second player assuming the role of the first player and making object selections. In this embodiment displayed awards may subsequently be specified by a game controller or another player who assumes the role of the second player.

In an embodiment there may be more than one second player. For example: (i) plural second players entitled to make concurrent award offers or (ii) plural second players entitled to make award offers in turn or (iii) plural second players entitled to take the role of the second player should the second player assume the role of the first player.

The game method may comprise executing a base game and commencing step (a) in response to occurrence of a trigger event in the base game.

In the second aspect, the invention also relates to a gaming system comprising:

a first player interface comprising a display for displaying a set of objects to a first player, and an instruction input mechanism that enables a player to input at least one object selection instruction, and, optionally, an award acceptance instruction or an award rejection instruction;

a second player interface comprising an instruction input mechanism to enable a second player to input an award instruction specifying an award to be displayed to a first player; and a game controller in data communication with the first and second player interfaces and configured to:

(a) cause the display of the first player interface to display to the first player an award based on an award instruction received from the second player that the first player can accept or reject.

In an embodiment, the game controller is configured to:

(b) (i) if an acceptance instruction is received from the first player grant the first player the displayed award or, (ii) if rejection instruction is received from the first player, receive at least one further object selection instructions from a first player, and a further award instruction from a second player specifying an award to be displayed to a first player, and the game controller is configured to repeat processes (b) and (c) until (i) an acceptance instruction is received or (ii) another award condition is met.

In the second aspect, the invention also relates to a game controller for a gaming system comprising a memory storing a set of objects, the game controller configured to:

(a) receive (i) at least one object selection instruction from a first player specifying selection of an object from the set of objects, and (ii) an award instruction from a second player specifying an award to be displayed to a first player; and (b) cause a first player display to display an award based on the received award instruction that the first player can accept or reject.

In an embodiment, the game controller is configured to:

(c) (i) if an acceptance instruction is received specifying that the first player accepts the displayed awards, grant the first player the displayed award or, (ii) if a rejection instruction is received specifying that the first player rejects the displayed award, receive at least one further object selection instruction and a further award instruction from a second player specifying an award to be displayed to a first player, and the game controller further configured to repeat processes (a), (b) and (c) until (i) an acceptance instruction is received or (ii) another award condition is met.

In a third aspect, the invention broadly relates to a method of gaming comprising:

(i) conducting a first selection round by (a) displaying a set of objects to a first player;

(b) receiving at least one object selection from the first player, and (c) displaying an award to the first player that the first player can accept or reject; and (ii) conducting at least a second selection round if the first player does not accept the displayed award, the second pick round comprising at least one further object selection being made other than by the first player.

In one embodiment, the further object selection may be made by a game controller.

In another embodiment, the further object selection may be made by a second player.

In the third aspect, the invention also relates broadly to a game controller for a gaming system comprising:

a memory for storing a set of objects, the game controller configured to:

(i) conduct a first selection round during which the game controller is configured to:

(a) cause a first player display a set of objects to a first player;

(b) receive at least one object selection instruction from the first player specifying an object of the set of objects and make the object identified by the selection unavailable;

(c) cause the first player display to display an award to the first player that the first player can accept or reject; and (ii) conduct at least a second selection round if the first player does not accept the displayed award during which at least one further object is selected other than by the first player.

The third aspect also provides a gaming system comprising:

a player interface having an instruction input mechanism;

a first player display for displaying a set of objects to a first player; and a game controller, the game controller configured to:

(i) conduct a first selection round during which the game controller is configured to:

(a) cause a first player display to display a set of objects to a first player;

(b) receive at least one object selection instruction from the first player and make the object identified by the selection unavailable;

(c) cause the first player display to display an award to the first player that the first player can accept or reject; and (ii) conduct at least a second round if the first player does not accept the displayed award during which at least one further object is selected other than by the first player.

Persons skilled in the art will appreciate that the above methods may be implemented by computer program code executed by a computer. Such program code may be provided on a computer readable medium. Persons skilled in the art will also appreciate that various features and embodiments of the above aspects may be combined.

Figure 1:
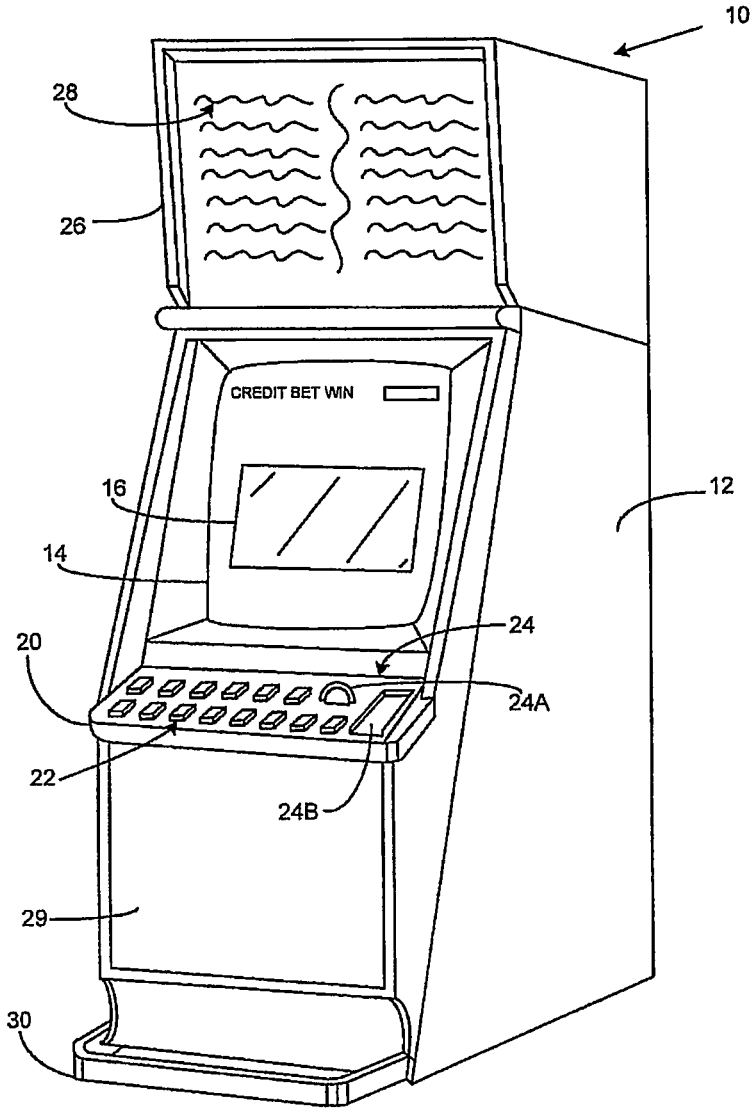
FIG. 1 is a perspective view of a gaming system in the form of a stand alone gaming machine.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DESCRIPTION OF EMBODIMENTS

Referring to the drawings, there is shown a gaming system arranged to implement a game where a player makes object selections which result in prizes becoming unavailable to the player. At various points in the game, the player is offered a prize that the player can accept or reject. The player can accept the prize or reject the prize and continue playing in the hope that they will get a larger prize offered to them. Two player variants of this game are also disclosed. The gaming system can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

A gaming system in the form of a stand alone gaming machine 10 is illustrated in FIG. 1. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module having a reading device may also be provided for the purpose of reading a player tracking device as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 2:
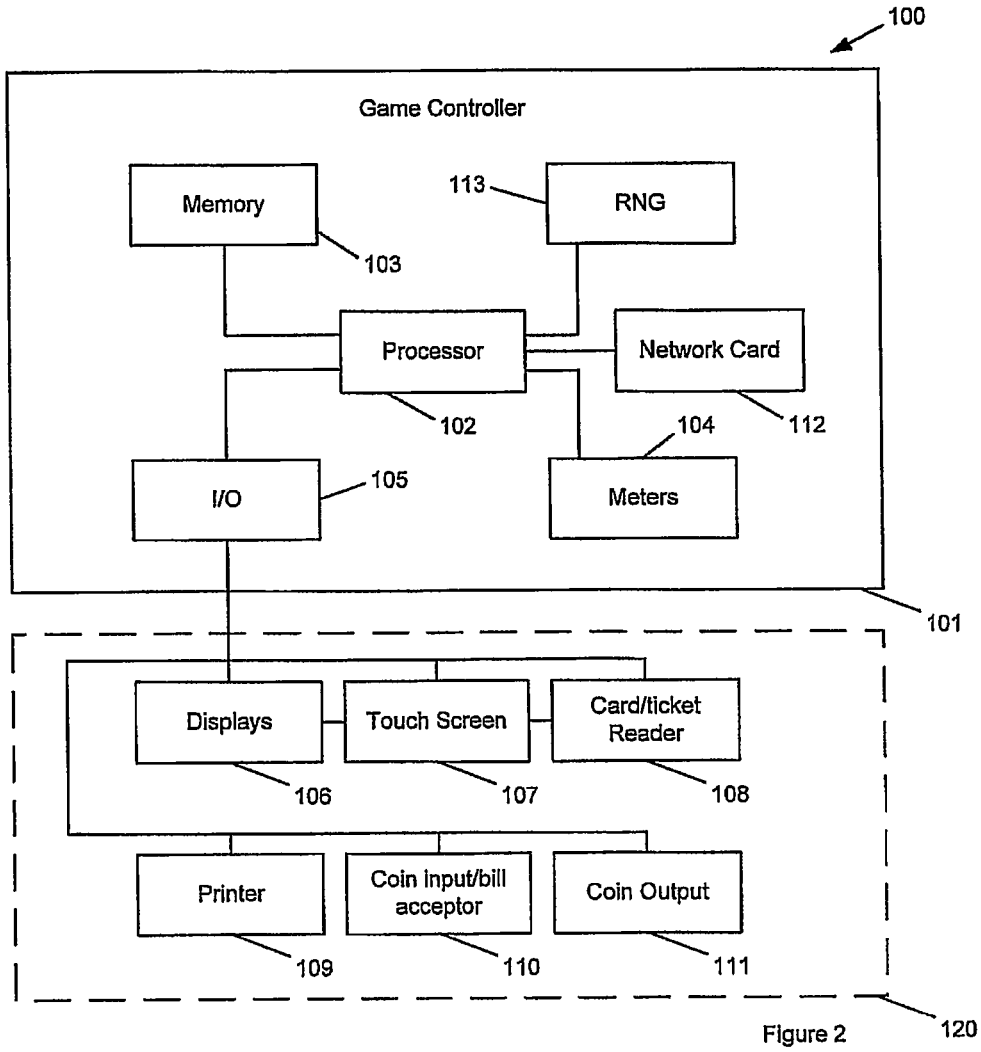
FIG. 2 is a schematic diagram of a gaming system.

FIG. 2 shows a block diagram of operative components of a typical gaming machine which may be the same as or different to the gaming machine of FIG. 1.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that a random number generator may employ a pseudo random number generation scheme. Herein, the term "random" is intended to encompass both truly random and pseudo-random.

In the example shown in FIG. 2, a player interface 120 includes peripheral devices that communicate with the game controller 101 including one or more displays 106, a touch screen 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 3:
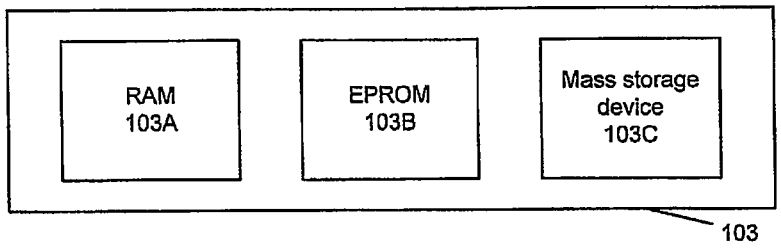
FIG. 3 is a schematic diagram illustrating the memory of FIG. 2.

FIG. 3 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 4:
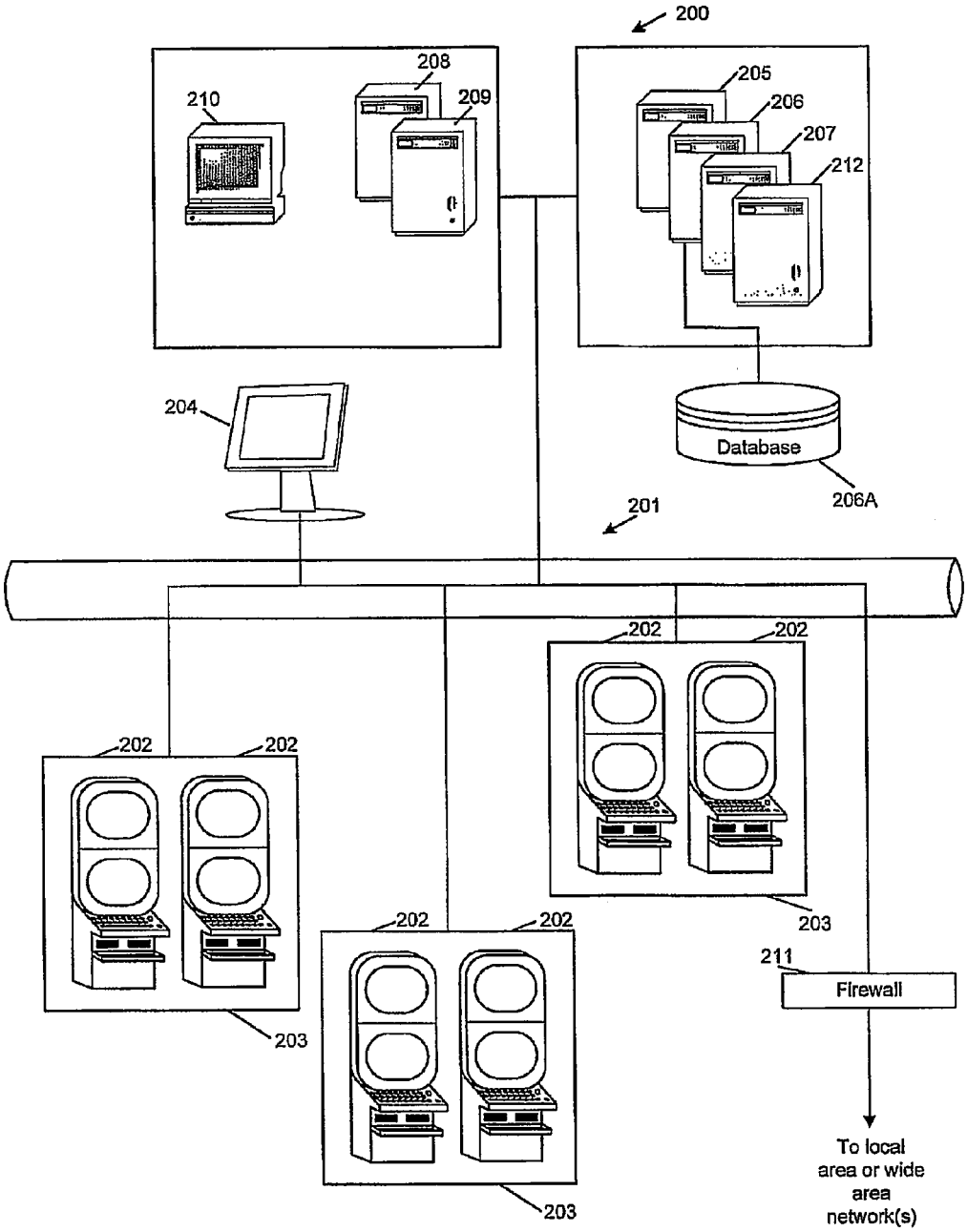
FIG. 4 is a schematic diagram of a gaming system having networked gaming machines.
Figure 5:
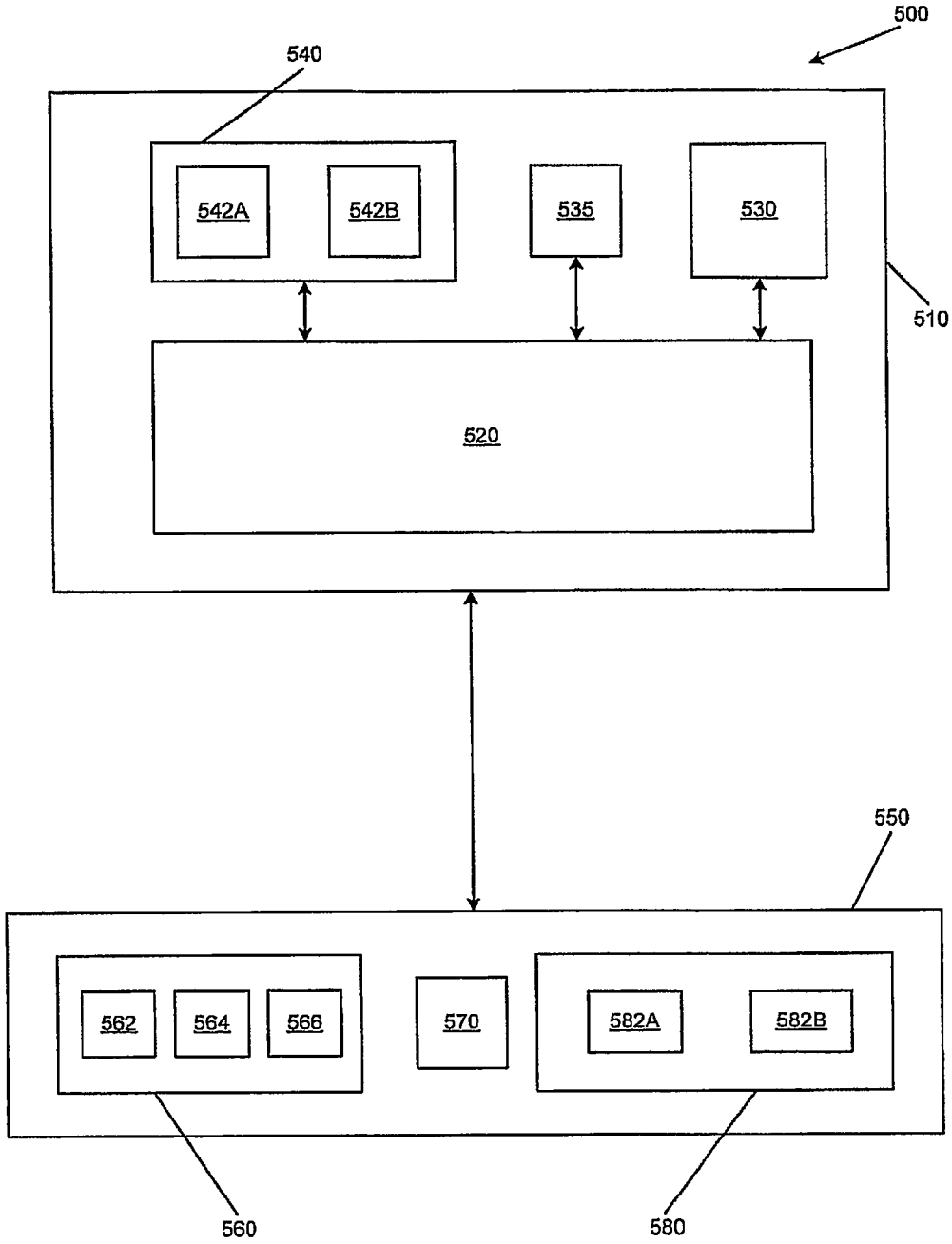
FIG. 5 is a block diagram of the functional components of a first embodiment.

FIG. 4 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 4, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller.

A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

First Embodiment

The gaming system of the first embodiment can be used to implement a game independently or as a "feature" game.

As an additional feature game it can be applied to any style of base game, for example, a spinning or slot game, keno, bingo, a dice game, a card game, a table game, etc.

The main functional components for implementing the first embodiment are illustrated in FIG. 5. A gaming system 500 has a game controller 510 and a player interface 550. The game controller 510 has a game processor 520, a random number generator 530 and a memory 540. The player interface 550 has an input mechanism 560, a credit input/output mechanism 570 and a display 580.

The rules for carrying out the game are stored as program code in memory 540. The code is executed by a game processor 520 in conjunction with player instructions input via input mechanism 560 in order to generate game outcomes.

In order to begin the game, the player inputs credit via credit mechanism 570 and operates input mechanism 560 to indicate they want to play the game. The game processor 520 generates new game data. In each new game, a range of prizes is displayed on a prize display. The player makes selections of objects that could improve or reduce the prize the player receives. Periodically, the player is offered the opportunity to get out of the game by accepting a prize. The prize offered to the player is typically less than some of the available prizes but more than others. Thus, the player has to decide whether to accept the prize or continue the game with the opportunity to obtain a greater prize but with the risk of a lesser prize. A series of objects is displayed to the player. Each time an object is selected, a prize is made unavailable to the player. After a predetermined number of objects have been selected, a prize that the player can accept or reject is displayed on a display.

In order to start each game, the processor 520 generates game data and an initial display displaying all of the objects. The processor 520 obtains the number of objects to be displayed and the set of prizes from memory 540. For example, the program code may specify that there are 15 objects and 15 prizes ranging in value from 100 credits to 50,000 credits. The game processor 520 processes random numbers from random generator 530 in order to randomly associate individual ones of the objects with individual ones of the prizes. The processor 520 then stores initial game data 542A in memory 540 which specifies the characteristics of each object including where they are to be displayed in a first region 582A of display 580 and the prize they are associated with. The processor 520 then controls display 580 to display the objects in a first region 582A of the display 580 and the prizes in a second region 582B of display 580, the display being such that the association of prizes and objects is not apparent to the player.

The processor also determines how many objects are to be selected by a player in a first selection round, for example, three. The processor controls the display 580 in order to display the number of objects selections the player must make to the player. In other embodiments, the number of selections may not be disclosed to the player.

The player then operates object selector 562 to make object selections. The object selector will typically be in the form of a touch screen interface that allows the player to touch any one of the displayed objects in order to select it. The player may additionally be asked to confirm their selection by pressing a portion of the touch interface. Persons skilled in the art will appreciate that other means for selecting the object could also be employed, for example, buttons corresponding to each of the individual objects. Each operation of the object selection causes an object selection instruction to be sent to the processor 520. The processor 520 determines the object to which the selection relates and updates the memory by incorporating additional game data 542B to specify that an object has been selected and to indicate that the prize associated with that object is made unavailable to the player. The processor then updates regions 582A and 582B of display 580 to indicate graphically that an object has been selected and a prize has become unavailable thereby revealing the association between objects and prizes. The processor 520 also updates the display to indicate how many selections now remain in the selection round. For example, if there were originally three selection in the selection round, the processor 520 updates display 580 to indicate that only two selections remain. Thus, in order to complete the selection round, the player is required to submit two further object selections via object selector 562.

After each object selection, the processor 520 adds additional data 542B and updates display 580. At the end of the selection round, the processor carries out a further process to determine an award to be displayed to the player. The processor determines a value of a prize from the value of the remaining prizes. For example, if each of the prizes are credits, the prize that is offered may be an average of the remaining prizes or some value related mathematically in some other way to the remaining prize or value.

Once the prize has been determined by processor 520 in accordance with the program code stored in memory 540, it is displayed to the player on display 580. The player then must operate either an acceptance selector 564 or a rejection selector 566 in order to enter an acceptance or rejection instruction. Assuming the player initially enters a rejection instruction, the processor 520 determines from memory 540 how many selections are to be made by a player in a second round and displays the number of selections to a player.

Figure 6:
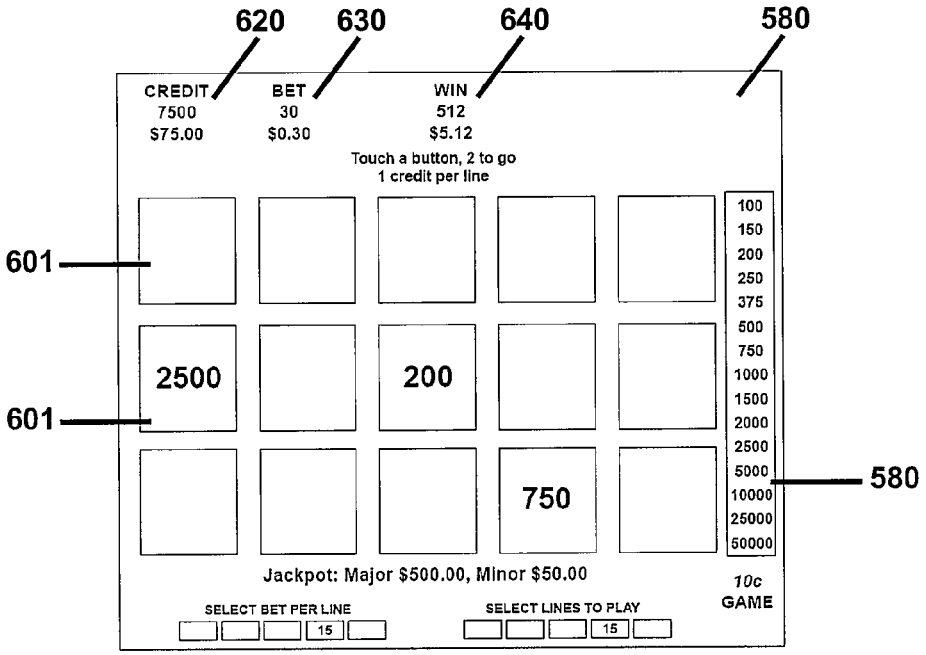
FIG. 6 is a screen shot of a display during playing of game in accordance with the first embodiment.

Such a scenario is illustrated in the screen shot of FIG. 6 where the objects are displayed as fifteen blocks in a major portion of the display 580. It will be recalled from above that three selections were made in a first selection round. The blocks are either rectangular 601 if they have not been selected or larger and square 602 if they have been selected. It will thus be seen from FIG. 6 that three blocks have been selected. Each selected block displays the prize that it was associated with. For example, block 602 indicates that it is associated with a prize of 2,500 credits. A second region 582B of the display towards the right of display 580 contains the set of prizes that were initially available to the player. Those prizes that are now unavailable to the player are shown is a different colour, for example, prize 612 of 2500 credits. The display 580 also displays a current value of the credit meter 620, and a bet amount 630, and a current value of the win meter 640. The display also indicates that a player must select two additional objects in this second selection round. Play continues with the player making two additional object selections using object selector 562.

Figure 7:
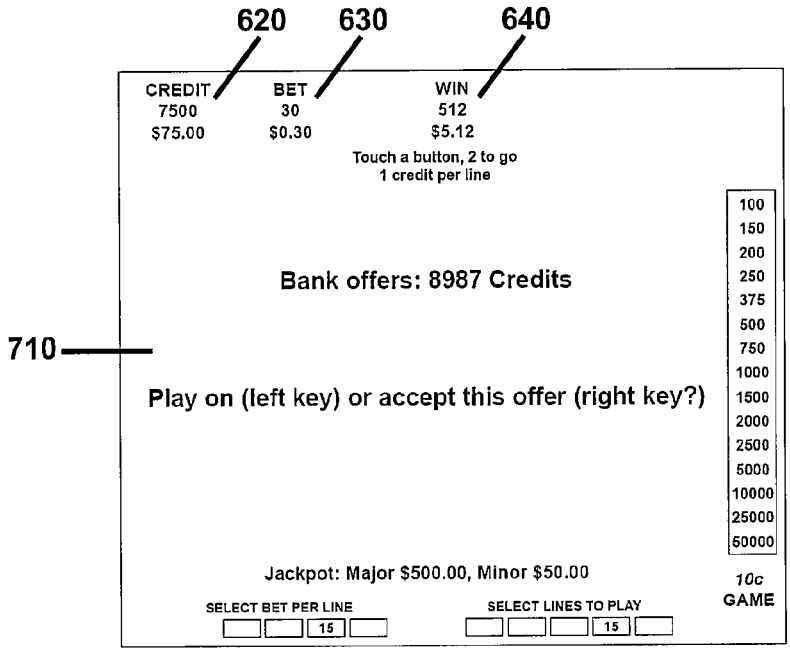
FIG. 7 is a screen shot of a display during playing of game in accordance with the first embodiment.

As described above, processor 520 updates both memory 542B and display 580 to indicate that the objects have been selected and that the prizes associated with them are unavailable. FIG. 7 illustrates the display at the end of such a pick round where the processor has determined an offer to be made to the player. Most of the display is "greyed" out. The display includes the text 710 "Bank offers:8987 Credits, Play on (left key) or accept this offer (right key)". Thus, the processor 520 has controlled the display so that the player is displayed a prize of 8987 credits that they can either reject by pressing the left key or accept by pressing the right key.

Game play continues under control of the processor 520 in the same manner as described above until a player enters an acceptance instruction using prize acceptor 564 or a last object remains whereafter the player is awarded a prize corresponding to the last object. If a player accepts a prize, the processor 520, updates of meters 535 including credit meter and win meter to reflect the prize that had been won and controls the display to show the prize won and to update the credit and win meters 620, 640.

Figure 8:
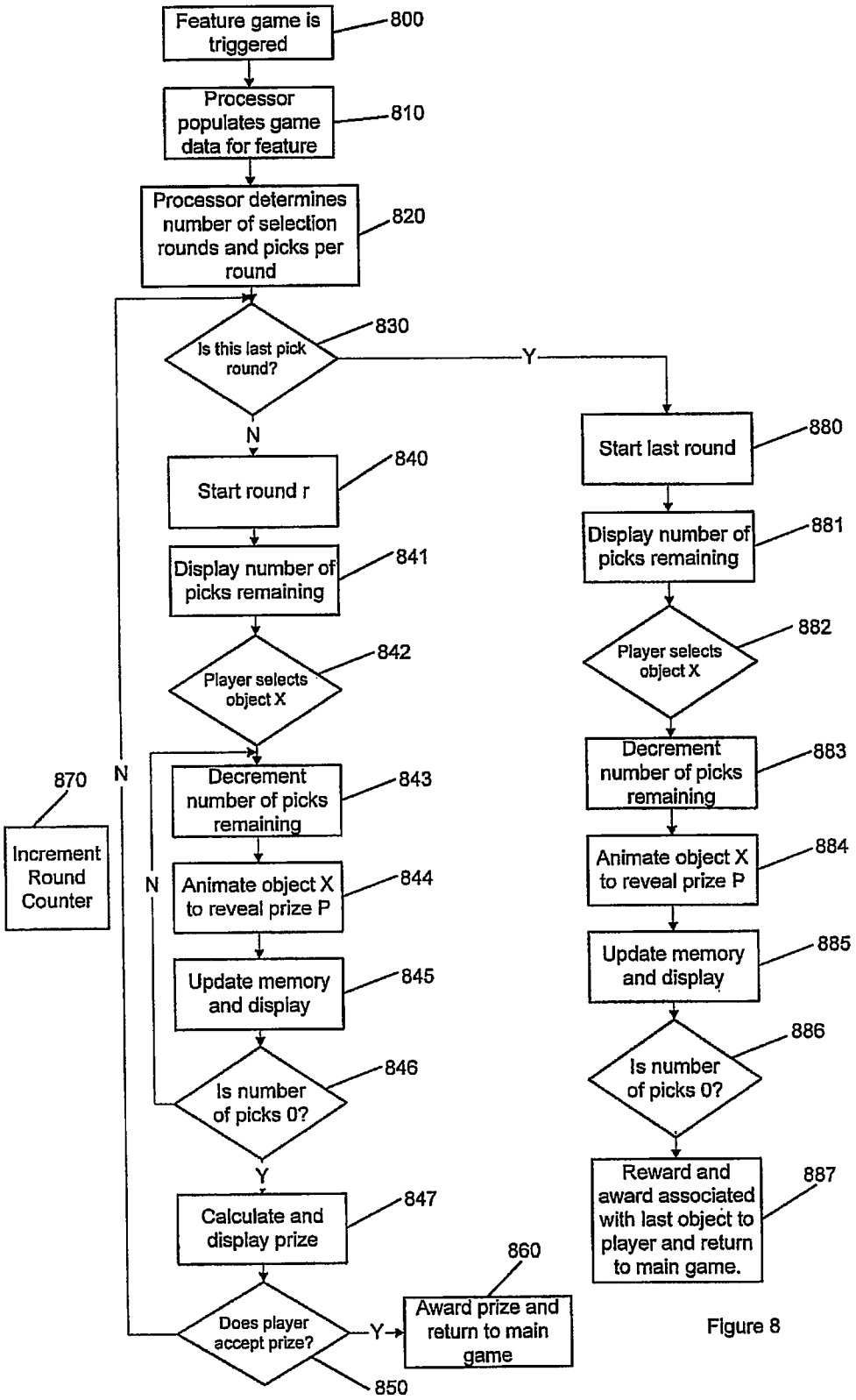
FIG. 8 is a flowchart corresponding to the first embodiment.

To further illustrate certain embodiments of the invention, reference is now made to the flow chart of FIG. 8. FIG. 8 proceeds on the assumption that the game is a feature game that may occur after a trigger event. A wide variety of appropriate trigger events are known to persons skilled in the art.

Examples of trigger events are:

random,
associated with an advertised combination,
associated with a non-advertised combination,
associated with a special bet,
associated with a time,
associated with a tournament,
associated with 1 or more specific game states,
associated with 1 or more console states, specific operator activity, and specific player activity.

The trigger can come from the game or a system connected to the game, for example.

After a trigger event occurs, the feature can commence automatically or be prompted by the player pressing a button or the like.

Referring to FIG. 8, at step 800 the feature game is triggered. At step 810, the processor 520 populates the game data, associates the objects and prizes and displays the objects on the display for the player to select. At step 820 the processor 520 determines the number of selection rounds and picks for each round. At step 830 the processor 520 determines whether the round is the last round. If it is not the last round, the round is started at step 840. The number of picks remaining for the round is displayed at step 841. At step 842, the player makes a decision as to which object to select by operating the object selector. At step 843, the processor 520 decrements the number of picks remaining for the round. At step 844, the processor 520 animates the object X on the display to reveal the prize P. At step 845, the processor 520 updates the memory and display to show the prizes that has been made unavailable. At step 846, the processor 520 determines whether the number of picks remaining for this round is zero. If it is not zero, the processor 520 repeats steps 841 to 845. If the number of picks remaining is zero at step 847, the processor 520 calculates and displays a prize. At step 850, the processor 520 determines whether the player accepts the prize. If the prize is accepted, the processor 520 awards the prize 860 and updates relevant meters before returning to the main game. If the player rejects the prize the processor 520 increments the round counter 870 and proceeds to step 830.

Processor 520 cycles through steps 830 to step 870 until it determines at step 830 that this is the last round. At step 880, the processor 520 displays the number of picks remaining. At step 882, a player selects an object and the processor 520 processes the received object selection instruction. At step 843, the processor 520 decrements the number of picks remaining. At step 884, the processor 520 animates object X to reveals prize P. At step 885, the processor 520 updates the memory and display to reflect the selection. At step 886, the processor 520 determines whether the number of picks is zero. In the last round, the number of picks being zero will coincide with one prize remaining. The processor 520 cycles through steps 841 to 846 until the number of picks is zero. At this stage, the processor 520 awards the prize associated with the last object of the player by revealing that prize to the player and returns to the main game.

It will be apparent from the above description that in a first embodiment, a single prize is associated with each object. Further, the player can select the objects in any order such that any object may be the last object and the identity of the last object is not known until the player makes a final selection.

Various modifications to the above game are possible. For example, the prizes can have a variety of values as well known in the art including in addition to credit prizes, progressive prizes, non-cash prizes, free games, bonus games, bonus symbols for use in the base game or extra picks.

It is envisaged that the prize on the display is of equal value to the prize revealed. However, in some embodiments the prize on display might be different to the prize revealed. For example, when the player selects an object or prize that is revealed and the prize that is eliminated from the prize display is close in value to the prize in the list of prizes.

Further, the number of objects can be constant for each feature game or can vary. The number of objects can be varied randomly or based on the bets placed by the player. Varying the number of objects can include decreasing or increasing the number. Varying the number of objects can also include swapping an object for another object kept in a reserved space.

Similarly, the number of selection rounds may be constant for each game or can be varied, for example, based on the number of bets, randomly or time when the game is played. Again, the number of selections for each round can be fixed or variable. Variations may be related to which round has been played or the size of the remaining prizes. In one example, if a particular prize, for example the highest prize is made unavailable to the player, a bonus or consolation prize may be provided to the player.

Further, the player may be offered assistance in making the decision to take the prize offered. For example, the machine can display the offer prize but give some indication of the mean value of the remaining prizes.

Figure 9:
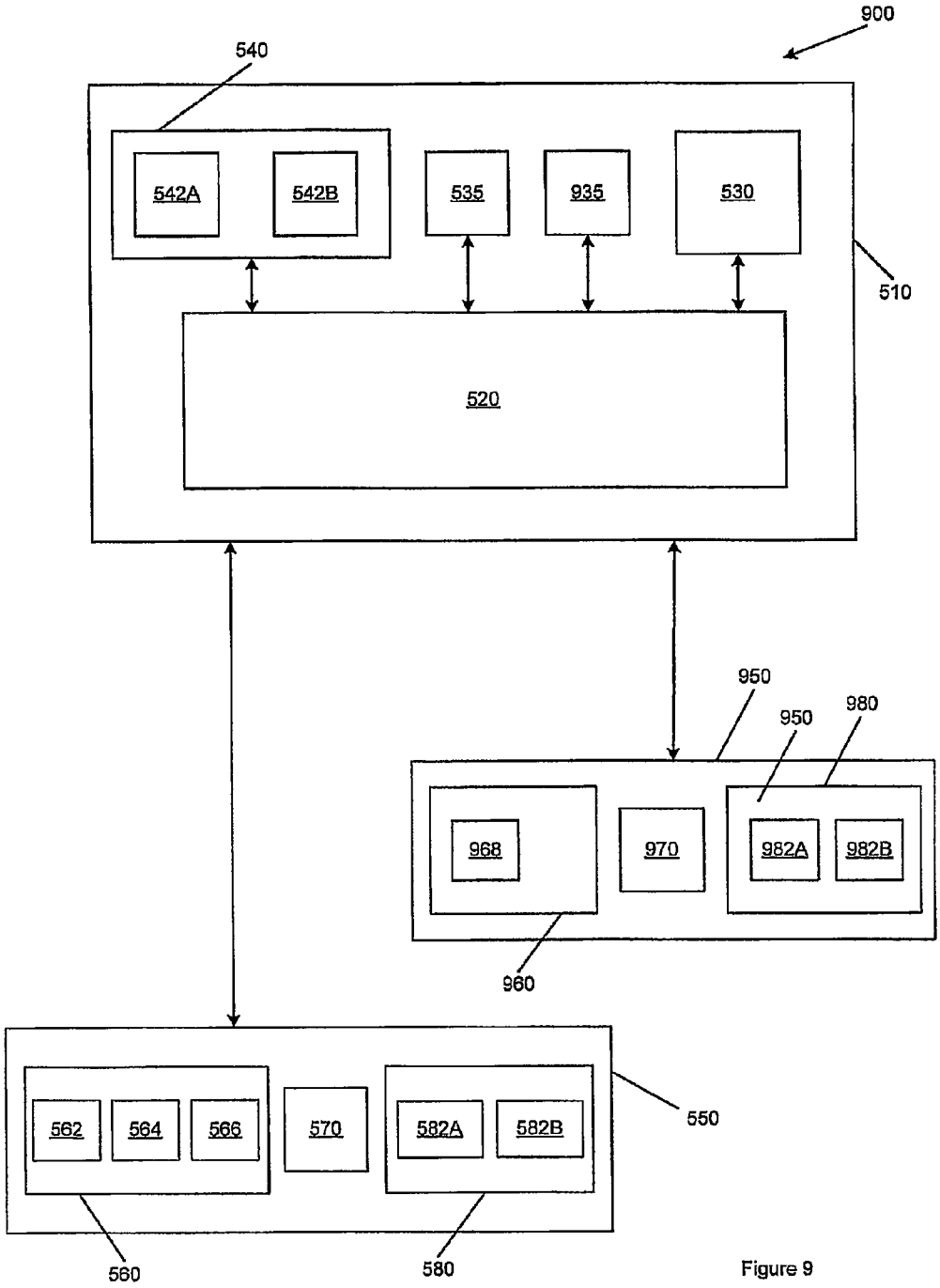
FIG. 9 is a block diagram of the functional components of the second embodiment.
Figure 10:
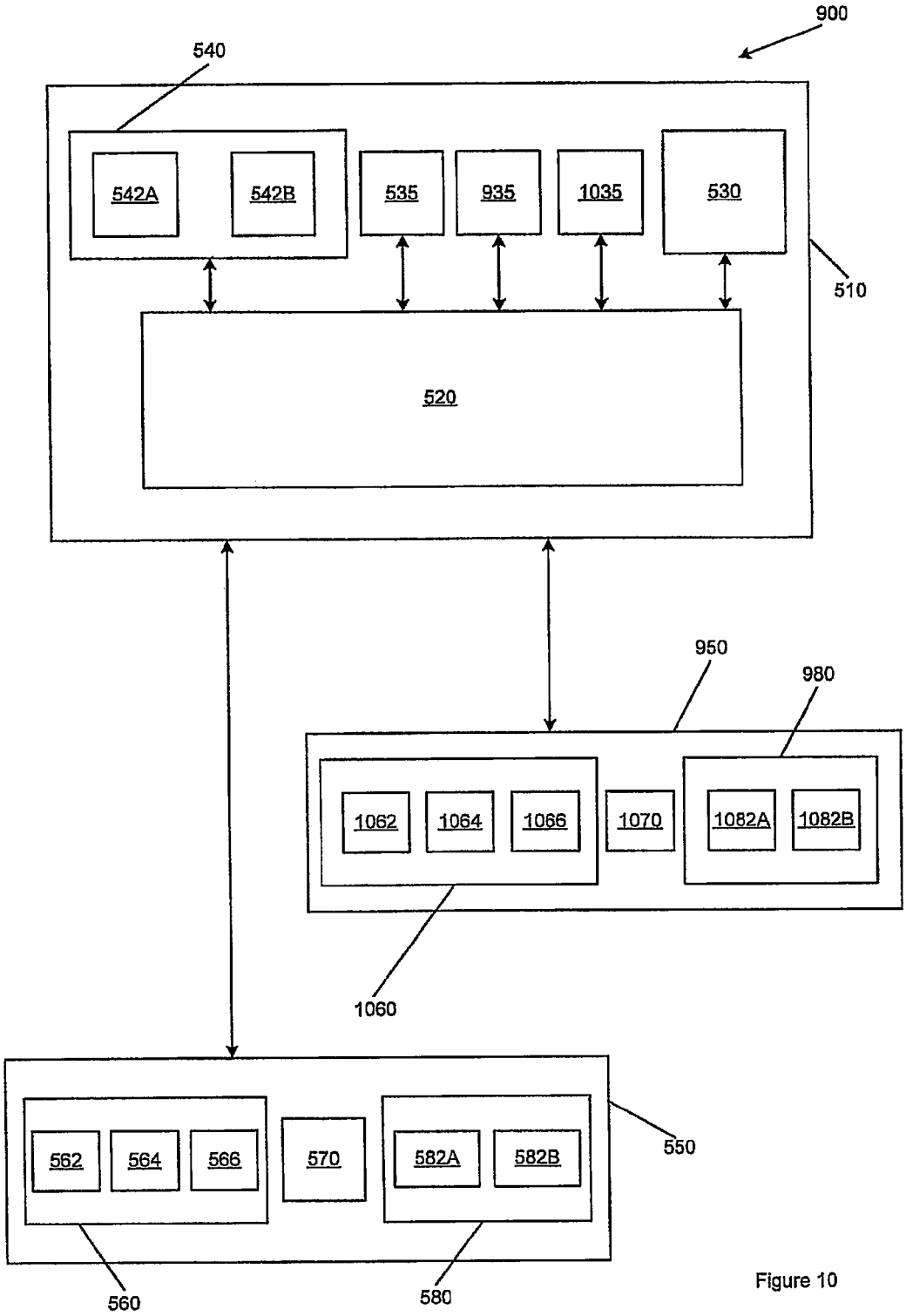
FIG. 10 is a block diagram of the functional components of the third embodiment.

Two further embodiments will now be described in relation to FIGS. 9 and 10. In FIGS. 9 and 10, where elements of substantially the same as those found in FIG. 5, the same numbering is used.

Second Embodiment

Referring to FIG. 9, there is shown a multiplayer embodiment. Where possible, a number consistent with the first embodiment is employed. Illustrated in FIG. 9 as a first player interface 550 which is the same as used in the interface of FIG. 5 and a second player interface 950. While only a single second player interface 950 is shown, is some variations there may be multiple second player interfaces as described in more detail below.

In the embodiment of FIG. 9, rather than the processor 520 determining the offers to be displayed to the player of the game who is operating the first player interface (a first player), the offers are made by a second player operating a second player interface 950. The second player interface also includes a credit input mechanism and a display 980 that has first and second regions 982A, 982B that display the same information as the first and second regions 582A and 582B of the first player interface. The game proceeds generally as indicated in relation to the first embodiment above until the end of the first object selection round. At this point in the game, the processor 520 causes a message to be displayed on the second player interface 950 to ask the player to enter their "bid". The user calculates a bid they are prepared to offer and either selects it from a range of possible bids or enters the bid as an award instruction using an award offer selector 968 of input mechanism 960.

Processor 520 then displays this offer on display 580 of the first user interface and the first player can accept or reject the offer in the same manner in which they accept or reject an offer in the first embodiment.

In a variant to the above, there may be multiple second player interfaces and players of each interface may be entitled to enter an offer and a player of the first interface may be entitled to accept any one of the offers. In a further variant, the player of the second interface or the player of each interface may have an option not to enter an offer in which case an offer is made by the game processor 520 instead.

As in the first embodiment, game play may continue through a series of pick rounds in which the first player rejects an offer. If the first player accepts an offer by operating the offer accepter 564, the game may be resolved in a number of ways. In one example, if the first player accepts a second player offer the credit meter of the first player is incremented by the displayed award and the credit meter 935 of the second player is incremented or decremented by the difference between what the second player has offered and an offer calculated by processor 520.

In a variation, the second player whose prize offer has been accepted by the first player is allowed to continue the game with further offers either being made by the game controller or by other second players. At this point, the second player interface operates substantially as per the first player interface, that is, the input functions of the first player interface become available to the input mechanism 960 of the second player interface. The player continues until they accept a prize and their credit meter is incremented or decremented by the difference between the prize they accept and the prize that the original first player accepted. Various other modifications will be apparent to persons skilled in the art.

It will be appreciated in the above discussion, that in this embodiment, play need not necessarily be able to continue till a last object is selected. That is, it may be terminated at an earlier stage. Further, the number of prizes in this embodiment need not necessarily equal the number of objects.

Third Embodiment

In the embodiment in FIG. 10, the second player interface is substantially identical to the first player interface. In this embodiment, the second player interface includes an input mechanism 1060 having an object selector 1062, an acceptance instruction selector 1064, and a rejection instruction selector 1066, a credit mechanism 1070, and a display 1080 having a first display region 1082A and a second display region 1082B, each operating the same as the display regions of the first player interface.

In this embodiment, first and second players operate the first and second player interfaces 550, 1050. Processor 520 determines conducts a first selection round where the first player makes selections and is offered awards calculated by the processor 520. If the first player accepts the award offered to them at the end of the first round, the prize is awarded to the first player the meter 535 is incremented. If play continues to the second round, play now switches to the second player interface with the second player making object selection by operating object selector 1062. At the end of the second round, the second player may accept or reject an award. If the player accepts the award, the second player's credit meter 1035 is incremented. Play continues with the players alternating turns until one of the players accepts an award or one of the players is left with the last object.

In a variation to this embodiment based on the second embodiment, the players input mechanisms may be modified to allow the players to input an award mechanism so that they can take turns to offer a prize to be displayed to the other player.

Various other modifications will be apparent to persons skilled in the art, in one example of this embodiment the number of objects may be different to the number of prizes. For example, in one example there might be 20 objects and three prizes and each of the objects are associated with letters such that as each object is selected, a letter is revealed and one of three words is populated, each of which is associated with a prize. For example, one word may be "bad luck" and the prize may be ten credits, a second word may be "winner" and the prize may be 100 credits, and a third word may be "jackpot" and the prize 1,000 credits. As each object is selected, a letter is revealed and one of the words is "populated". Completion of the word leads to the prize associated therewith being awarded to the player that completes that word. Accordingly, it will be appreciate that at least two objects will remain in this example when a player completes a word and maybe more offers are made based on the likelihood on a word being completed.

It will be appreciated the second and third embodiment will typically be conducted in a network gaming environment such as illustrated in FIG. 5. However, persons skilled in the art will appreciate that the third and second embodiment can be carried out on a stand alone gaming machine with players taking it in turns to operate a single interface which is adapted to act as both a first and second player interface, for example, a touch screen interface can be readily reconfigured with a different display in order to allow first and second players to input different instructions.

These and other variations will be apparent to persons skilled in the art as falling within the scope of the invention described herein.

The invention claimed is:

1. A method of operating a gaming machine for playing of a game by a player via a controller and a display in conjunction with another player playing a second gaming machine, the method comprising:

(a) displaying at a display a number of objects and a number of prizes, each of the number of objects being associated with a respective one of the number of prizes and each of the respective one of the number of prizes being hidden by its respective associated object;

(b) receiving at a controller an object selection indicative of a selected one of said objects, every received object selection resulting in the prize associated with the received object selection being revealed and becoming unavailable, and displaying said one of the prizes associated with said selected one of said objects;

(c) displaying at said display an award for ending the game, and allowing said award to be accepted or rejected by the player, said displaying at said display an award for ending the game comprising displaying said award for ending the game offered by another player;

(d) (i) if said displayed award has been accepted at said controller by the player, granting the player the displayed award and adjusting a second award for said another player based on the granted displayed award, or (ii) if said displayed award has been rejected at said controller, each further object selection resulting in a further one of said prizes becoming unavailable; and (e) repeating steps (c) and (d) until either (i) an award has been accepted or (ii) a last one of said number of objects remains, wherein the prize associated with the last one of said number of objects is awarded.

2. A method as claimed in claim 1, wherein each one of the objects is associated with an individual prize of the set of prizes, the objects being displayed, at least initially, such that associations between objects and prizes are unknown to the player.

3. A method as claimed in claim 1, and further comprising, if a last object remains, awarding the player the prize associated with the last object.

4. A method as claimed in claim 1, wherein exiting the game, is deemed an acceptance instruction.

5. A method as claimed in claim 1, and further comprising determining the award displayed to the player based on the prizes associated with objects that have not been selected at the time the award is displayed.

6. A method as claimed in claim 1, and further comprising displaying the association between an object and a prize after the object has been selected.

7. A method as claimed in claim 1, and further comprising determining the number of object selections available to a player, randomly.

8. A method as claimed in claim 1, and further comprising determining the number of object selections available to a player in response to one or more bets.

9. A method as claimed in claim 1, and further comprising executing a base game and commencing step (a) in response to occurrence of a trigger event in the base game.

10. A gaming system for playing a game by a player in conjunction with another player playing a second gaming machine, the gaming system comprising:

a player interface comprising:

(1) a display for displaying a number of objects and a number of prizes to the player, each of the number of objects being associated with a respective one of the number of prizes and each of the respective one of the number of prizes being hidden by its respective associated object;

(2) an instruction input mechanism that enables a player to input an object selection instruction to select an object and, an award acceptance instruction or an award rejection instruction;

an another player interface operable by the another player; and the game controller in data communication with the another player interface, and configured to:

(a) reveal a prize associated with a selected object and make said prize associated with said selected object unavailable to the player in response to every object selection instruction, and display the prize associated with said selected object;

(b) cause the display to display to the player an award for ending the game that the player can accept or reject and that is offered by said another player; and (c) (i) if an acceptance instruction is received from the player accepting the displayed award, grant the player the displayed award and adjust an award for said another player based on the granted displayed award, or (ii) if a rejection instruction is received from the player rejecting the displayed award, receive at least one further object selection instruction from a player selecting a further one of said set of objects, the game controller further configured to repeat processes (a), (b) and (c) until (i) an acceptance instruction is received or (ii) a last one of said number of objects remains, wherein the prize associated with the last one of said number of objects is awarded to the player.

11. A gaming system as claimed in claim 10, wherein each one of the objects is associated with an individual prize of the set of prizes, the objects being displayed, at least initially, such that associations between objects and prizes are unknown to the player.

12. A gaming system as claimed in claim 10, wherein the game controller is configured such that, if a last object remains, the game controller awards the player the prize associated with the last object.

13. A gaming system as claimed in claim 10, wherein the game controller deems exiting of the game to be an acceptance instruction.

14. A gaming system as claimed in claim 10, wherein the game controller determines the award displayed to the player based on the prizes associated with objects that have not been selected at the time the award is displayed.

15. A gaming system as claimed in claim 10, wherein the game controller controls the display to display the association between an object and a prize after the object has been selected.

16. A gaming system as claimed in claim 10, wherein the game controller determines the number of object selections available to a player randomly.

17. A gaming system as claimed in claim 10, wherein the game controller determines the number of object selections available to a player in response to one or more bets.

18. A gaming system as claimed in claim 10, and configured to execute a base game and commence the display of objects step in response to occurrence of a trigger event in the base game.

19. A game controller for a game system, the game controller comprising:

a memory storing a number of objects and a number of prizes for a game to be played by a player, each of the number of objects being associated with a respective one of the number of prizes and each of the respective one of the number of prizes being hidden by its respective associated object, the game controller configured to:

(a) receive at least one object selection instruction specifying a selected object;

(b) reveal a prize associated with a selected object and make said prize associated with said selected object unavailable to the player in response to every object selection instruction, and display a prize associated with said selected object;

(c) cause a display to display to the player an award for ending the game that the player can accept or reject by the player, and wherein said award for ending the game is offered by another player; and (d) (i) if an acceptance instruction is received specifying that the player accepts the displayed award, grant the player the displayed award and adjust an award for said another player based on the granted displayed award, or (ii) if a rejection instruction is received specifying that the player rejects the displayed award, receive further object selection instructions specifying a further object of the set of objects, the game controller further configured to repeat processes (b), (c) and (d) until (i) an acceptance instruction is received or (ii) a last one of said number of objects remains, wherein the prize associated with the last one of said number of objects is awarded to the player.

20. A player interface for playing a game in a game system, the player interface comprising:

a display for displaying a number of objects and a number of prizes to a player, each of the number of objects being associated with a respective one of the number of prizes and each of the respective one of the number of prizes being hidden by its respective associated object;

an instruction input mechanism that enables a player to input an object selection instruction to select an object, (a) the display being updated:

(i) to indicate that a prize associated with an object selection has been made unavailable to the player in response to every object selection instruction;

(ii) to reveal the prize associated with said selected object, (iii) to display to the player an award for ending the game that the player can accept or reject by the player, and wherein said award for ending the game is offered by another player, (b) the instruction input mechanism enabling a player to enter (i) an acceptance instruction accepting the displayed award and an adjustment an award for said another player based on the granted displayed award, or (ii) a rejection instruction rejecting the displayed award, and if a rejection instruction is entered, the instruction input mechanism enabling the player to enter at least one further object selection instruction, the player interface configured to repeat processes (a) and (b) until (i) an acceptance instruction is entered or (ii) a last one of said number of objects remains, wherein the prize associated with the last one of said number of objects is awarded to the player.

* * * * *